US008720806B2

(12) United States Patent
Mahler

(10) Patent No.: US 8,720,806 B2
(45) Date of Patent: May 13, 2014

(54) LABORATORY GRINDER HAVING ROTARY LEAD-THROUGHS FOR GRINDING BEAKERS THE SPECIFICATION OF WHICH

(75) Inventor: Stefan Reinhold Mahler, Velbert (DE)

(73) Assignee: Retsch GmbH, Haan (DE)

( * ) Notice: Subject to any disclaimer, the term of this patent is extended or adjusted under 35 U.S.C. 154(b) by 324 days.

(21) Appl. No.: 13/146,837

(22) PCT Filed: Jan. 26, 2010

(86) PCT No.: PCT/EP2010/000427

§ 371 (c)(1),
(2), (4) Date: Aug. 30, 2011

(87) PCT Pub. No.: WO2010/086132

PCT Pub. Date: Aug. 5, 2010

(65) Prior Publication Data

US 2011/0303776 A1 Dec. 15, 2011

(30) Foreign Application Priority Data

Jan. 28, 2009 (DE) ..... 10 2009 006 500

(51) Int. Cl.
*B02C 17/14* (2006.01)

(52) U.S. Cl.
USPC ..... 241/57; 241/175; 241/179; 241/DIG. 37

(58) Field of Classification Search
USPC ..... 241/57, 175, 179, DIG. 37
See application file for complete search history.

(56) References Cited

U.S. PATENT DOCUMENTS 3,579,920 A 5/1971 Heiberger
5,364,036 A * 11/1994 Falcon-Steward ..... 241/21

FOREIGN PATENT DOCUMENTS

DE 100 02 054 7/2001
GB 1 265 735 3/1972

* cited by examiner

*Primary Examiner* — Mark Rosenbaum
(74) *Attorney, Agent, or Firm* — Jennifer S. Stachniak; Robert W. Becker

(57) ABSTRACT

A laboratory grinding mill having at least one grinding bowl configured to carry out a rotary movement about its central axis, and designed for conveying a liquid or gaseous medium therethrough. A rotary lead-through device having a stationary part and a movable part is coupled to the movement of the grinding bowl. The stationary part is provided with at least one connection for a stationary conduit, and the movable part is provided with at least one connection with a conduit that leads to the grinding bowl.

15 Claims, 2 Drawing Sheets

LABORATORY GRINDER HAVING ROTARY LEAD-THROUGHS FOR GRINDING BEAKERS THE SPECIFICATION OF WHICH

BACKGROUND OF THE INVENTION

The instant application should be granted the priority dates of Jan. 28, 2009, the filing date of the corresponding German patent application 10 2009 006 500.8, as well as Jan. 26, 2010 the filing date of the International patent application PCT/EP2010/000427.

The present invention relates to a laboratory grinder comprising at least one grinding beaker carrying out a rotary movement about the central axis thereof, the grinding beaker being connected to at least one line for conducting a liquid or gaseous medium.

Such a laboratory grinder is known, for example, in the form of a vibration grinding mill or a planetary ball mill having a ratio of 1:−1. To the extent that it is known that brittle materials can be reduced in size particularly efficiently in such laboratory grinding mills, there is effected in appropriate cases an additional embrittlement of the material that is to be ground by cooling with liquid nitrogen. For this purpose, the liquid nitrogen must be continuously supplied to the moving grinding beaker, and must be withdrawn therefrom. In this connection, it is known to carry out the supply of the grinding beaker with the liquid or gaseous medium, for example nitrogen, by means of appropriately arranged flexible hoses. In this connection, the hoses are secured directly to the grinding beaker holder, whereby a fluidic connection can then exist between the grinding beaker holder and the inserted grinding beaker. During practical use, however, these hose connections have a shorter useful life due to the great amplitude of the alternating stress brought about by the movement of the grinding beaker. In particular during the use of liquid nitrogen, additional safety precautions are therefore necessary in order to preclude the endangerment of personnel should the hose connections fail.

In addition to the nitrogen application, other applications of mechanical energy during the grinding process utilize the brief local release of large quantities of energy for the introduction of chemical reactions. Depending upon the reactions that occur, under certain circumstances the grinding beaker must be cooled or heated. This also requires the continuous supply of the grinding beaker with a medium for tempering the reaction chamber.

In yet other applications, during the reduction in size of the material that is to be ground gases are released that can be the subject matter of a further analysis. These gases must therefore be continuously withdrawn from the grinding beaker, and the withdrawn volume must be compensated for by a corresponding supply of gas.

All of the previously addressed applications have the problem of conducting liquid or gaseous media to a moving grinding beaker, and it is therefore an object of the present invention to provide a laboratory grinding mill having the aforementioned features that ensures a reliable connection of the correspondingly required lines or conduits for conducting liquid or gaseous media therethough.

SUMMARY OF THE INVENTION

The basic concept of the invention is that the line is guided by means of a rotary lead-through or transmitting device having a stationary part and a movable part coupled to the movement of the grinding beaker, wherein the stationary part comprises at least one connection for a stationary or fixed line, and the movable part at least one connection for a line leading to the grinding beaker.

The invention has the advantage that the connection of the grinding beaker with the supply and withdrawal line for the medium can be effected via a to a large extent rigid line system because the relative movement between the movable grinding beaker and the stationary supply or withdrawal system is compensated for by the movable part of the interposed rotary lead-through that is movable relative to the stationary part. The respective movements are reduced within the rotary lead-through to as small a radius as possible, so that due to the thus minimized relative velocity and relative movement between the stationary part and the movable part of the rotary lead-through device, a contacting seal can be utilized that is effective between the bore sections that are aligned with one another in the stationary part as well as in the movable part of the rotary lead-through device.

Pursuant to one specific embodiment of the invention, two lines for the supply and the withdrawal of the medium are connected to each grinding beaker and both lines are guided via the rotary lead-through device, whereby respectively two external and internal connections are formed on the stationary part and on the movable part of the rotary lead-through device.

Pursuant to an exemplary embodiment of the invention, not only in the stationary part but also the movable part of the rotary lead-through device bores for conducting the medium through the rotary lead-through device are formed, and the bores in the stationary part and in the movable part respectively have a section that is aligned with one another and that extends in the axis of movement of the movable part.

With regard to the production of a sealed line path, pursuant to one exemplary embodiment of the invention the sections of the bores that are formed in the rotary lead-through device and are aligned with one another are respectively sealed relative to one another between the stationary part and the movable part.

In particular, for this purpose a projecting nose can be formed on the movable part of the rotary lead-through device in continuation of the aligned section of the bore, with the projecting nose engaging in a positive or form-fitting manner in a recess formed in the stationary part, whereby a seal is disposed between the nose and the recess.

Pursuant to an alternative embodiment of the invention, with respect to the arrangement of the components of the rotary lead-through device relative to one another, the stationary part of the rotary lead-through device can be sealed radially or also at the end face relative to the movable part.

To the extent that it is known that laboratory grinding mills contain a number of grinding beakers, pursuant to one exemplary embodiment of the invention correspondingly also a plurality of grinding beakers can be provided, each of which then has associated with it a rotary lead-through device.

To the extent that it is also known in the state of the art to secure the grinding beakers in grinding beaker holders disposed on the laboratory grinding mill, it is proposed pursuant to an exemplary embodiment of the invention to connect the at least one line to the grinding beaker holder, and to fluidically connect the grinding beaker holder to the grinding beaker. In conformity therewith, the rotary lead-through device is then associated with the grinding beaker holder.

To the extent that with different constructions of laboratory grinding mills the grinding beakers can also carry out different movements, it is proposed pursuant to one exemplary embodiment of the invention that the grinding beakers carry out only a movement over a part of a circle. Since with such an embodiment also the relative movement of the movable part of the rotary lead-through device is limited relative to the stationary part, with such an embodiment of the laboratory grinding mill the connections formed on the stationary part can be connected with the connections formed on the movable part by means of flexible line sections.

Alternatively, the grinding beakers can carry out a rotational movement in the associated holder, whereby correspondingly a rotational movement must be designed for the movable part of the rotary lead-through device.

Pursuant to one exemplary embodiment of the invention, the central axes of the grinding beakers rotate about an axis of a device that is spaced therefrom, whereby a respective rotary lead-through device is associated with each rotational axis. This feature characterizes, for example, a planetary mill, where the grinding beaker rotates concentrically about the central axis of the planetary disc, while at the same time this planetary disc rotates about the center point of the sun gear. With such superimposed circular movements, at least one rotary lead-through device must then be used per rotational center.

Finally, with respect to the use of the laboratory grinding mill, the medium is a liquid nitrogen or the liquid or gaseous medium that is utilized is tempered, for example in order to produce a heating or cooling effect for the grinding beaker, or the medium is comprised of a special analysis or test gas.

BRIEF DESCRIPTION OF THE DRAWINGS

Exemplary embodiments of the invention, which will be described subsequently, are shown in the drawings, in which.

DESCRIPTION OF SPECIFIC EMBODIMENTS

Figure 1:
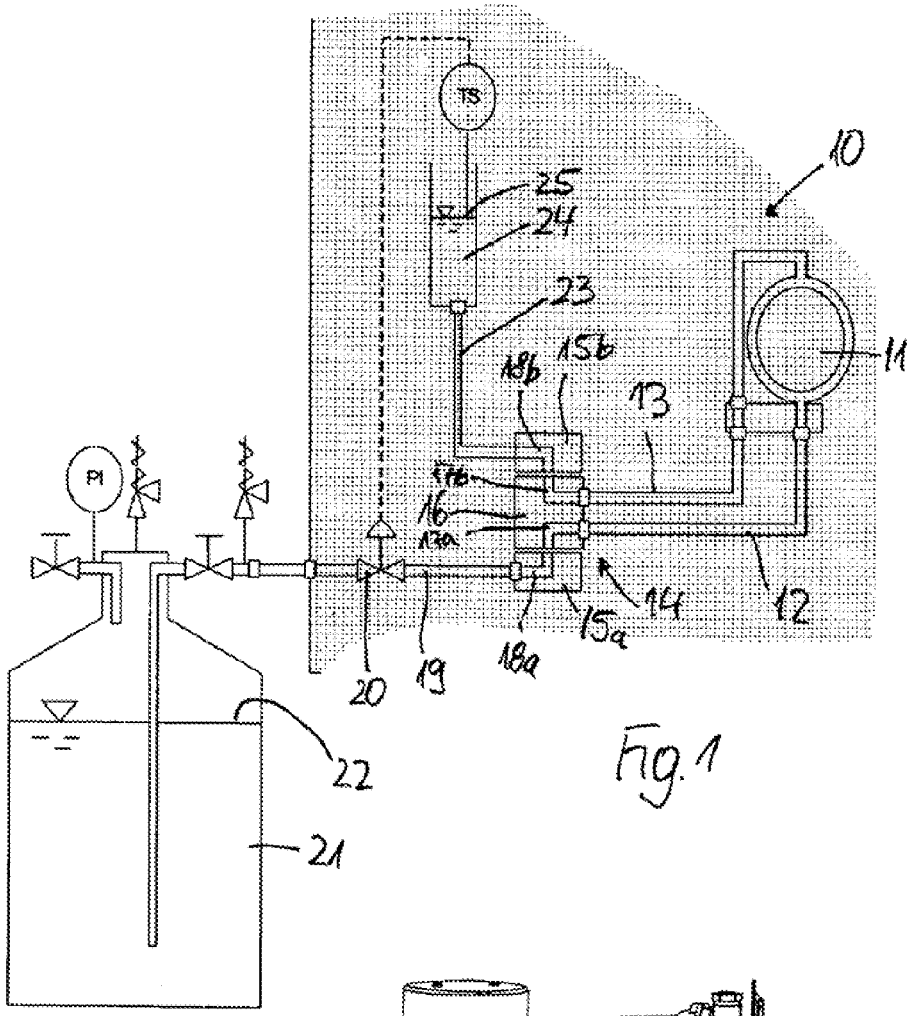
FIG. 1 is a schematic illustration of a laboratory grinding mill that is designed for operation with liquid nitrogen and that has associated supply and removal devices and an interposed rotary lead-through device.

As can be seen from FIG. 1, the laboratory grinder or grinding mill 10, which is illustrated only schematically, is provided with a grinding bowl or beaker 11, to which are connected a supply line or conduit 12 and a return line or conduit 13 for supplying the grinding beaker 11 with liquid nitrogen. With respect to the movement of the grinding beaker 11, the lines 12 and 13 are guided by means of a rotary lead-through or transmitting device 14 that has a stationary part 15 and a movable part 16. The stationary part 15 is comprised of two parts 15*a*, 15*b* that accommodate the movable part 16 between them and that are supported against one another by means of a non-illustrated holder that is to be connected to the housing of the laboratory grinding mill 10. Two bores 17*a* and 17*b* are formed in the movable part 16, whereby the bore 17*a* is connected to the supply line 12, and the bore 17*b* is connected to the return line 13. In the movable part 16 of the rotary lead-through device 14, the bores 17*a* and 17*b* are respectively angled outwardly by 90 degrees, where they are connected to bores 18*a* and 18*b* correspondingly formed in the stationary parts 15*a* and 15*b*, whereby the line sections of the bores 17*a*, 18*a* and 17*b*, 18*b* respectively that are aligned with one another are disposed in the axis of movement of the movable part 16 relative to the stationary part 15.

Connected to the bore 18*a* of the stationary part 15*a* is the line or conduit 19, which proceeds from a supply tank 21 for the liquid nitrogen, whereby appropriate valves 20 having control and safety functions are disposed in the line 19. Liquid nitrogen is present in the supply tank 21 at a liquid level 22.

Connected to the bore 18*b* of the stationary part 15*b* is a return line or conduit 23, which is guided to a collection receptacle 24 in which there is also liquid nitrogen having a liquid level 25.

From the arrangement it can be seen that the movable part 16 can be moved relative to the stationary part 15 of the rotary lead-through device 14 without having to disconnect or interrupt the line transition between the bores 17*a*, 18*a* and 17*b*, 18*b* respectively disposed in the aforementioned parts.

Figure 2:
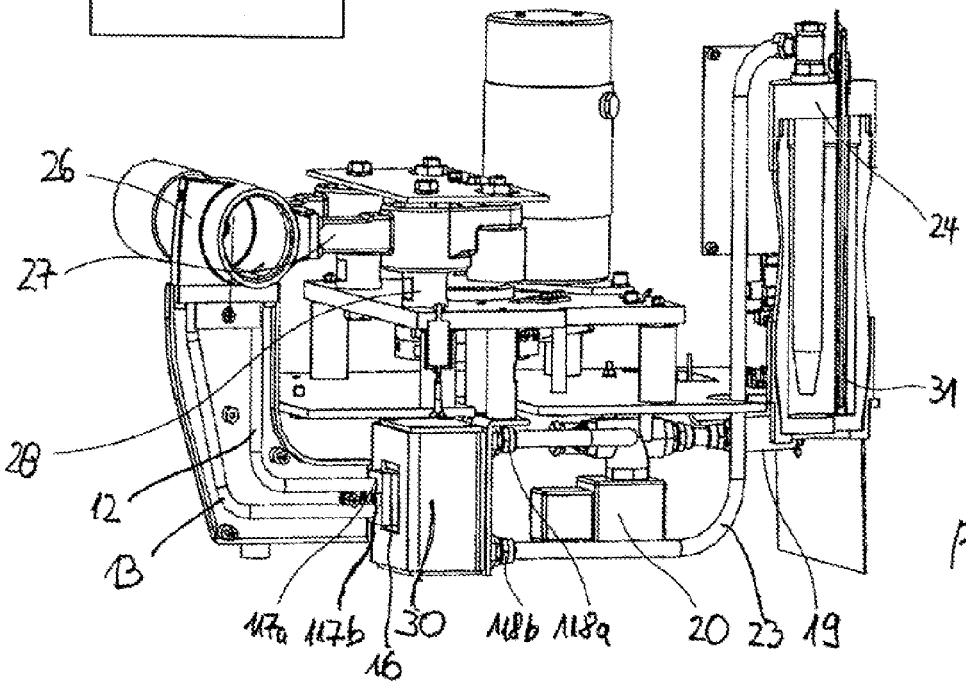
FIG. 2 is a perspective overall view of the construction of a laboratory grinding mill that is embodied as a vibration grinding mill having a grinding beaker and associated rotary lead-through device.

The configuration of the corresponding lead-through device 14, in conjunction with the laboratory grinding mill 10, can be seen from FIG. 2. Here, the supply line 19 for the liquid nitrogen is illustrated, and is connected by means of an appropriately disposed valve 20 to a connection 118*a* of the stationary part 15 of the rotary lead-through device 14. From the illustrated embodiment it can be seen that the two individual parts 15*a* and 15*b* of the stationary part 15 are held in place by a holder 30 that is connected to the housing of the laboratory grinding mill 10. In a corresponding manner, the return line 23 proceeds to the collection receptacle 24 from the stationary part 15*b*, i.e. from the connection 118*b* thereof.

FIG. 2 shows the movable part 16 with its connections 117*a* and 117*b* for the lines or conduits connected thereto, namely the line 12 and the return line 13, both of which are guided to a grinding beaker holder 26 and are connected thereto. The holder 26 for a grinding beaker is secured to a rotatably mounted swivel arm 27 and carries out an oscillating movement about the axis of movement 28; this consequently generates the grinding element movement in the interior of a non-illustrated grinding beaker that is inserted into the grinding beaker holder 26 and that is connected to the grinding beaker holder 26 in a fluidic manner. In this connection, the rotary lead-through device 14 is disposed in such a way that its center, namely the aligned bore section 17*a*, 18*a* and 17*b*, 18*b* respectively, are aligned with the extended axis of movement 28.

The liquid nitrogen is conveyed into the rotary lead-through device 14 via the supply line 19 and the control valve 20, as well as via the connection 118*a*, and leaves the rotary lead-through device 14 via the supply line 12 that is connected to the connection 117*a* of the movable part 16. A nitrogen stream is guided to the grinding beaker holder 26, and from there again back to the movable part 16 of the rotary lead-through device 14, and finally passes via the stationary part 15 of the rotary lead-through device 14, and the return line 23 connected thereto, into the connection receptacle 24. As soon as a sensor 31 disposed on the collection receptacle 24 comes into contact with the liquid nitrogen, the control valve 20 is closed. After enough nitrogen has been evaporated such that the sensor is no longer wetted therewith, the control valve 20 is again opened.

Figure 3:
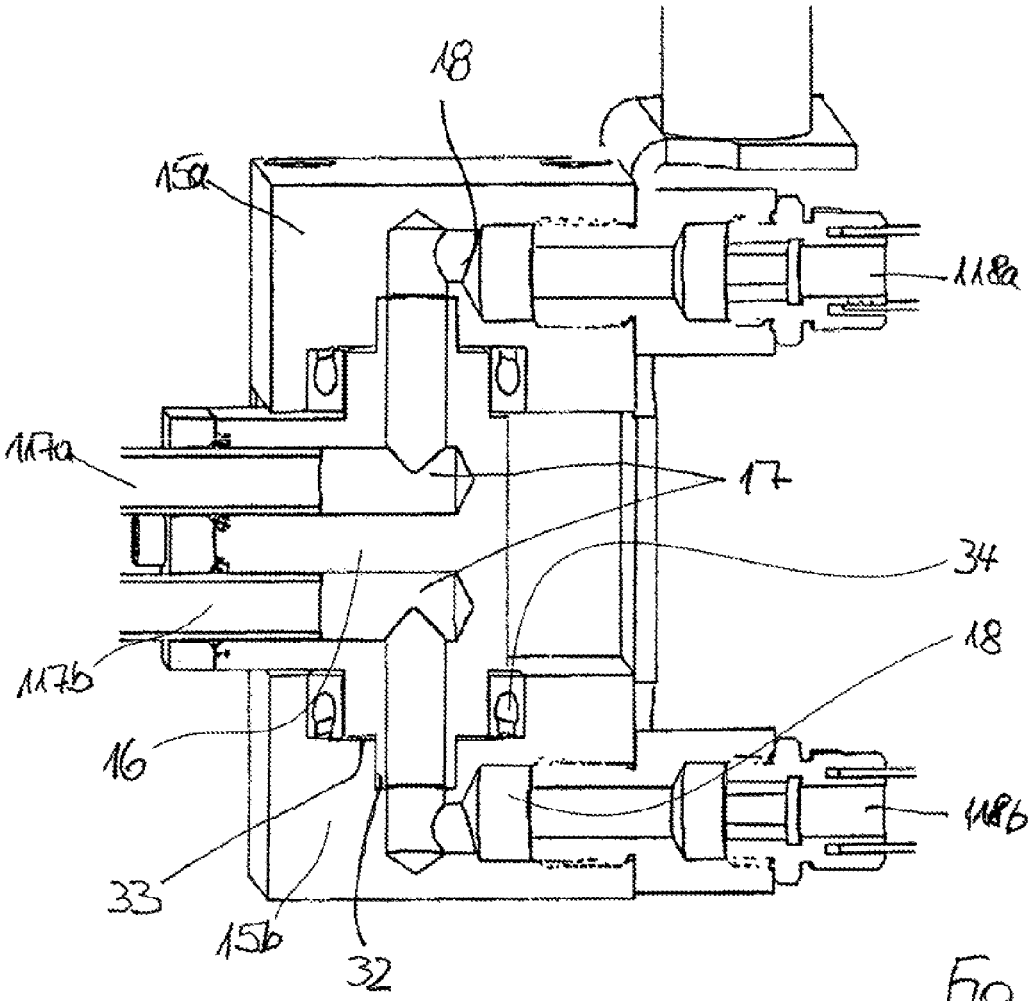
FIG. 3 shows the configuration of the rotary lead-through device of FIG. 2 in an enlarged view.

As can be seen in greater detail in FIG. 3, respective radially projecting noses 32 of the movable part 16 extend into a recess 33 respectively formed on the two stationary parts 15*a* and 15*b*, whereby disposed in the recess 33 is a radial seal 34 that surrounds the nose 32 of the movable part 16 and by means of its sealing lip seals the stationary part 15*a* and 15*b* respectively relative to the movable part 16. To the extent that with the illustrated embodiment this sealing means is configured in a radial arrangement, the sealing means can also be effected at the end faces.

Figure 4:
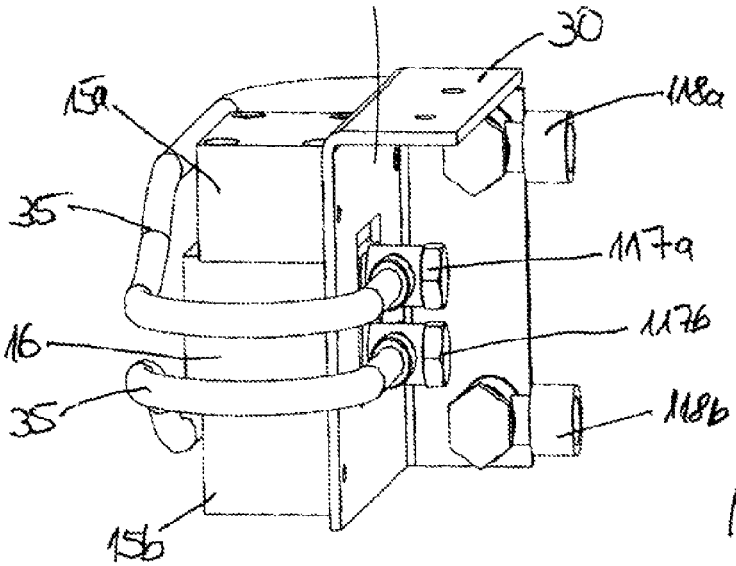
FIG. 4 shows another embodiment of the rotary lead-through device of FIG. 3.

With the embodiment of the invention illustrated in FIG. 4, no bores are formed in the interior of the stationary part 15 and the movable part 16; rather, the associated connections 118*a*, 118*b* for the feed line 19 and the return line 23 respectively are connected to the stationary parts 15*a*, 15*b* on the one hand, and the connections 117*a*, 117*b* for the supply line 12 and the return line 13 are connected to the movable part 16 on the other hand, in both cases by means of flexible line sections 35, for example hose connections; however, such a design is expedient only with laboratory grinding mills, the grinding beakers 11 of which carry out a movement over part of a circle.

The features of the subject matter of these documents disclosed in the preceding description, the patent claims, the abstract and the drawing can be important individually as well as in any desired combination with one another for realizing the various embodiments of the invention.

The specification incorporates by reference the disclosure of German 10 2009 006 500.8 filed Jan. 28, 2009, as well as International application PCT/EP2010/000427 filed Jan. 26, 2010.

The present invention is, of course, in no way restricted to the specific disclosure of the specification and drawings, but also encompasses any modifications within the scope of the appended claims.

The invention claimed is:

1. A laboratory grinding mill, comprising:

at least one grinding bowl configured to carry out a rotary movement about a central axis of said grinding bowl, wherein said at least one grinding bowl is also configured for conveyance of a liquid or gaseous medium through said grinding bowl;

a rotary lead-through device having a stationary part and a movable part that is coupled to movement of said at least one grinding bowl;

wherein said stationary part is provided with at least one connection for a respective fixed stationary conduit; and wherein said movable part is provided with at least one connection for a respective conduit that leads to said at least one grinding bowl, wherein connected to each grinding bowl is a first conduit for supplying medium to said grinding bowl and a second conduit for withdrawal of medium from said grinding bowl, wherein both said first conduit and said second conduit are guided via said rotary lead-through device, and wherein each of said stationary part and said movable part of said rotary lead-through device is provided with two of said connections.

2. A laboratory grinding mill according to claim 1, wherein bores for conveying the medium through said rotary lead-through device are formed not only in said stationary part but also in said movable part of said rotary lead-through device, and wherein said bores in said stationary part and said bores in said movable part are each provided with a section that is aligned with one another and extends in an axis of movement of said movable part.

3. A laboratory grinding mill according to claim 2, wherein said sections of said bores that are formed in said parts of said rotary lead-through device and are aligned with one another are respectively sealed relative to one another between said stationary part and said movable part.

4. A laboratory grinding mill according to claim 3, wherein a projecting nose is formed on said movable part of said rotary lead-through device, in a continuation of said aligned section of said bore, further wherein said nose engages in a positive manner in a recess formed in said stationary part, and wherein a seal is disposed between said nose and said recess.

5. A laboratory grinding mill according to claim 3, wherein said stationary part of said rotary lead-through device is sealed radially relative to said movable part.

6. A laboratory grinding mill according to claim 3, wherein said stationary part of said rotary lead-through device is sealed relative to said movable part at facing end faces of said parts.

7. A laboratory grinding mill according to claim 1, wherein a plurality of grinding bowls are provided, and wherein a respective rotary lead-through device is associated with each of said grinding bowls.

8. A laboratory grinding mill according to claim 1, wherein for each grinding bowl a respective holder is provided on said laboratory grinding mill and carries out a rotary movement, further wherein said grinding bowl is secured in place in said holder, further wherein said at least one respective conduit of said movable part is connected to said grinding bowl holder, and wherein said holder is fluidically connected with said grinding bowl.

9. A laboratory grinding mill according to claim 1, wherein said grinding bowl carries out a rotary movement over part of a circle.

10. A laboratory grinding mill according to claim 9, wherein said at least one connection of said stationary part is connected to said at least one connection of said movable part via respective flexible conduit sections.

11. A laboratory grinding mill according to claim 1, wherein said at least one grinding bowl carries out a rotational movement.

12. A laboratory grinding mill according to claim 1, wherein said central axis of said at least one grinding bowl rotates about an axis of a device spaced therefrom, and wherein a respective rotary lead-through device is associated with each rotational axis.

13. A laboratory grinding mill according to claim 1, wherein the medium is liquid nitrogen.

14. A laboratory grinding mill according to claim 1, wherein the liquid or gaseous medium is tempered.

15. A laboratory grinding mill according to claim 1, wherein the medium is analysis gas.

* * * * *